US005592888A

United States Patent [19]

Berwein et al.

[11] Patent Number: 5,592,888

[45] Date of Patent: Jan. 14, 1997

[54] PROCESS AND APPARATUS FOR DISPOSING OF WASTE

[75] Inventors: Heinz-Jürgen Berwein, Höchstadt; Gerd Baumgärtel, Röttenbach, both of Germany

[73] Assignee: Siemens Aktiengesellschaft, Munich, Germany

[21] Appl. No.: 529,587

[22] Filed: Sep. 18, 1995

Related U.S. Application Data

[63] Continuation of PCT/DE94/00255, Mar. 8, 1994, published as WO94/21751, Sep. 29, 1994.

[30] Foreign Application Priority Data

Mar. 17, 1993 [DE] Germany ..... 43 08 551.2

[51] Int. Cl.[6] ..... F23G 5/12

[52] U.S. Cl. ..... 110/229; 110/346; 110/211

[58] Field of Search ..... 110/210–214, 229, 110/230, 346, 246, 226

[56] References Cited

U.S. PATENT DOCUMENTS 4,541,345 9/1985 Grumpelt et al. ..... 110/229
4,878,440 11/1989 Tratz et al. ..... 110/229 X
5,170,725 12/1992 Sass et al. ..... 110/346 X
5,236,470 8/1993 Levin ..... 110/214 X

FOREIGN PATENT DOCUMENTS 0302310 6/1990 European Pat. Off. .
3310534 10/1984 Germany .

*Primary Examiner*—Henry A. Bennett
*Assistant Examiner*—Susanne Tinker
*Attorney, Agent, or Firm*—Herbert L. Lerner; Laurence A. Greenberg

[57] ABSTRACT

In a process and an apparatus for disposing of waste, the waste is carbonized at low temperatures in a carbonization drum, to develop carbonization gas and solid carbonization residue. The carbonization gas is burnt in a combustion chamber and the carbonization residue is divided in a separation device into a coarse and a fine fraction. The fine fraction is subjected to a gasification in a gasifier, to develop synthesis gas and molten slag. A temperature within the gasifier is above a melting temperature of non-combustible substances introduced into the gasifier. The synthesis gas is burnt in the combustion chamber or in a combustion chamber of a gas engine.

15 Claims, 1 Drawing Sheet

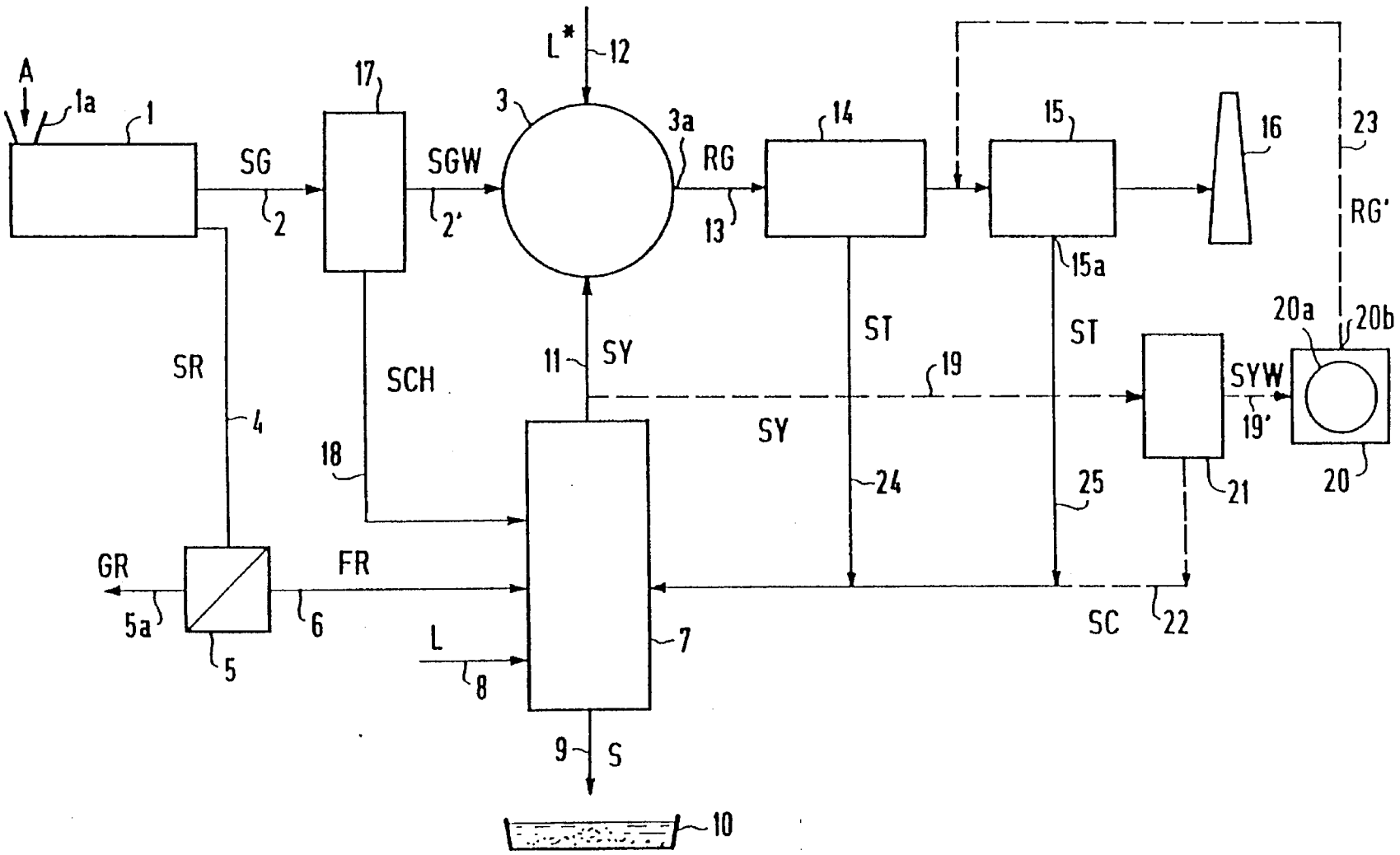
A
1a
1
SG
2
SR
4
5
5a
GR
FR
6
L
8
SCH
18
17
SGW
2'
3
L*
12
3a
RG
13
14
ST
24
SY
19
15
15a
ST
25
SC
22
16
21
SYW
19'
20a
20b
20
RG'
23
7
SY
11
S
9
10

PROCESS AND APPARATUS FOR DISPOSING OF WASTE

Cross-Reference to Related Application

This application is a Continuation of International Application PCT/DE94/00255, filed Mar. 8, 1994 published as WO94/21751, Sep. 29, 1994.

BACKGROUND OF THE INVENTION

Field of the Invention

The invention relates to a process for disposing of waste, in which the waste is carbonized at low temperatures, to develop carbonization gas and solid carbonization residue, the carbonization gas is burned and the carbonization residue is divided into a coarse and a fine fraction. The invention also relates to an apparatus for disposing of waste, having a waste feed device that discharges into a carbonization drum from which a carbonization gas outlet line and a carbonization residue outlet line discharge, the carbonization gas outlet line is connected to a combustion chamber which has a flue gas outlet, and the carbonization residue outlet line is connected to a separator which has outlet lines for a coarse and a fine fraction.

Such a process and such an apparatus for thermal waste disposal are disclosed in European Patent 0 302 310 B1, corresponding to U.S. Pat. No. 4,878,440. That apparatus has a carbonization drum into which the waste to be disposed of is introduced. The waste is carbonized at low temperatures there and carbonization gas and a solid carbonization residue are produced. The carbonization gas is supplied directly to a combustion chamber. The carbonization residue is divided into a coarse and a fine fraction and the fine fraction, if appropriate after a grinding operation, is fed into the combustion chamber as is the carbonization gas. The materials being fed in are burned there at high temperature and molten slag is formed which is discharged into a waterbath. Flue gas which is also produced is subjected to flue gas purification.

German Published, Non-Prosecuted Application DE 38 28 534 A1 discloses a process for thermal waste disposal in which, after the low-temperature carbonization operation, some of the carbonization residue is ground and then gasified as dust. A gasifier supplies a crude gas which drives a turbine and a gasifying residue which is burnt in a high-temperature furnace. The gasifier only serves to generate the crude gas. All of the solid matter must be fed from the gasifier to the high-temperature furnace. The apparatus, up to the high-temperature furnace, must therefore be dimensioned to be just as large as if no gasifier were connected in between the low-temperature carbonization device and the high-temperature furnace.

SUMMARY OF THE INVENTION

It is accordingly an object of the invention to provide a method and an apparatus for disposing of waste, which overcome the hereinafore-mentioned disadvantages of the heretofore-known methods and apparatuses of this general type and in which the method can be carried out and the apparatus can be provided more cost effectively than in the prior art. In particular, it should be possible to develop smaller amounts of flue gas in the process and in the apparatus.

With the foregoing and other objects in view there is provided, in accordance with the invention, a process for disposing of waste, which comprises carbonizing waste at low temperatures, to develop carbonization gas and solid carbonization residue; burning the carbonization gas; dividing the carbonization residue into a coarse and a fine fraction; subjecting the fine fraction to a gasification at a gasification temperature above a melting temperature of materials being subjected to the gasification and not being combustible, to develop synthesis gas and molten slag; and burning the synthesis gas unpurified.

Since the fine fraction of the carbonization residue is first gasified and only then is the synthesis gas formed during this gasification burned, a small burner capacity is advantageously sufficient, since even in the gasification process it is ensured that, because of the high temperature, all non-flammable substances of the fine fraction become molten and are separated off from the gasifier as molten slag. Only the flammable substances of the fine fraction, e.g. all carbon-containing substances, are gasified and later burned. The volume of the fine fraction of the carbonization residue corresponding to the slag therefore does not pass into the combustion chamber. Besides, in the process according to the invention, advantageously, only gas is burnt. Since on one hand only gases and no solid matter, and on the other hand relatively small amounts, are burnt, only small amounts of flue gas develop which are generally purified and then discharged. This is considered to be a particular advantage.

In accordance with another mode of the invention, the synthesis gas can be burnt separately, but, for example, also together with the carbonization gas from the carbonization drum. In the latter case, only a single combustion chamber is necessary which can be constructed to be small and cost-effective because of the separation of the slag in the gasification process.

In accordance with a further mode of the invention, the combustion can be performed, for example, with a feed of oxygen-enriched air. This improves the combustion process. Pure oxygen can also be fed.

In accordance with an added mode of the invention, either oxygen-enriched air or even pure oxygen is fed to the fine fraction of the carbonization residue in the gasification. This gives the advantage of permitting a temperature optimum for the gasification process to be achieved in the gasifier. The oxygen-enriched air can contain, for example, 70% oxygen. In order to perform the gasification, a temperature, for example, of approximately 2000° C., can prevail in the gasifier.

Since oxygen-enriched air or even pure oxygen is fed into the gasification process, a high temperature is achieved in the gasifier with a comparatively small external energy supply. Despite this, the gasification can proceed with an oxygen deficit if correspondingly small amounts of air or oxygen are fed into the gasifier.

After a gasification process with oxygen deficit, the majority of the synthesis gas is formed of carbon monoxide which can then be burned.

In accordance with an additional mode of the invention, the carbonization gas produced by the carbonization drum is scrubbed. The scrubbed carbonization gas is then burnt and the sludge that is separated off during scrubbing can be gasified. The advantage of this is that only a small amount of solid matter passes into the combustion chamber. No solid constituents of the carbonization residue are fed to the combustion chamber, which is already a result of the upstream gasifier. Since only gases are burnt in the combustion chamber, a simply constructed, small and cost-effective combustion chamber is advantageously sufficient.

By way of example, the synthesis gas may also be scrubbed before burning and the sludge that is separated out during this is gasified. This process step also contributes to keeping the combustion chamber free of solid matter, which makes a cost-effective combustion chamber sufficient.

In accordance with yet another mode of the invention, in the combustion of synthesis gas and carbonization gas, flue gas develops and it can be freed of dust in a flue gas purification. This dust is fed, for example, to the gasifier which is present anyway and is gasified there. This ensures that the dust from the flue gas is incorporated into the molten slag.

In accordance with yet a further mode of the invention, the molten slag is introduced, for example, from a gasifier into a water bath. Melt granules are formed there which are not hazardous to the environment and can be used, for example, as building material.

The synthesis gas can be burnt, for example, in the combustion chamber of a gas engine. This can drive a generator for producing electrical energy, for example.

In accordance with yet an added mode of the invention, thermal energy can be taken off from the flue gas which is developing, for example by a heat exchanger. The electrical and/or thermal energy can be used in many ways.

With the objects of the invention in view, there is also provided an apparatus for disposing of waste, comprising a waste feed device; a carbonization drum disposed downstream of the waste feed device; a carbonization gas outlet line and a carbonization residue outlet line discharging from the carbonization drum; a combustion chamber being connected to the carbonization gas outlet line and having a flue gas outlet; a separation device being connected to the carbonization residue outlet line and having a coarse fraction outlet line and a fine fraction outlet line; a gasifier being connected to the fine fraction outlet line and having a slag outlet line and a synthesis gas outlet line; and a combustion chamber being directly connected to the synthesis gas outlet line.

The addition of the gasifier in which the temperature is so high that molten slag is produced, achieves the advantage that apart from the carbonization gas, only synthesis gas must be fed to a combustion chamber. A small and thus cost-effective combustion chamber is therefore sufficient. This is due to the fact that on one hand the solid constituents of the fine fraction of the carbonization residue are already separated off in the gasifier and that on the other hand virtually only gases are fed to the combustion chamber. This also results in little flue gas arising which must also be given off, preferably after flue gas purification. Consequently, a smaller flue gas purification device is sufficient. Two small combustion chambers, one for carbonization gas and the other for synthesis gas, can alternatively be present.

The synthesis gas outlet line of the gasifier can lead to a conventional combustion chamber and/or to the combustion chamber of a gas engine. This gas engine can be connected to a generator for producing electrical energy.

In accordance with another feature of the invention, the carbonization gas outlet line of the carbonization drum and the synthesis gas outlet line of the gasifier can open out into separate combustion chambers or into the same combustion chamber.

In accordance with a further feature of the invention, the gasifier has a feedline for oxygen-enriched air or for pure oxygen. The feed of oxygen ensures a high temperature in the gasifier.

In accordance with an added feature of the invention, the carbonization gas outlet line of the carbonization drum is connected to a first gas scrubber from which a line for scrubbed carbonization gas and a line for sludge discharge. The line for the scrubbed carbonization gas can be connected to the combustion chamber and the line for the sludge can be connected to the gasifier. This ensures that the carbonization gas is purified prior to entry into the combustion chamber. The sludge that is separated off can be disposed of or can preferably be gasified together with the fine fraction of the carbonization residue in the gasifier. The combustion chamber is thereby kept substantially free of solid matter so that a simple construction of the combustion chamber is sufficient.

In accordance with an additional feature of the invention, the synthesis gas outlet line of the gasifier can be connected to a second gas scrubber from which one line for scrubbed synthesis gas leads to the combustion chamber and one line for sludge returns to the gasifier. This measure also ensures that virtually no solid matter passes into the combustion chamber.

In accordance with yet another feature of the invention, there is provided a flue gas purification device at the flue gas outlet of the combustion chamber, having a dust outlet which is connected, for example, to the gasifier. This advantageously introduces dust from the flue gas into the gasifier where, if it is not gasified, it is incorporated into the molten slag.

In accordance with yet a further feature of the invention, there is provided a heat exchanger being connected, for example, downstream of the flue gas outlet in order to recover thermal energy from the hot flue gas.

In accordance with a concomitant feature of the invention, the slag outlet line of the gasifier leads into a water vessel so that melt granules are formed there which can serve, for example, as building material.

The advantage of the process and the apparatus according to the invention is that the fine fraction of the carbonization residue and if appropriate sludges and dusts as well are first gasified, so that a combustible synthesis gas and melt granules develop. The melt granules can be used as raw material. The synthesis gas is burnt separately or together with the carbonization gas from the carbonization drum. Since no solid matter need be burnt, a simply constructed, small and cost-effective combustion chamber is advantageously sufficient. Consequently, little flue gas which must be given off also develops and only a small flue gas purification device is required.

Other features which are considered as characteristic for the invention are set forth in the appended claims.

Although the invention is illustrated and described herein as embodied in a method and an apparatus for disposing of waste, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

The FIGURE of the drawing is a schematic and block circuit diagram of an apparatus for carrying out the method for disposing of waste according to the invention.

DESCRIPTION OF THE PREFERRED EMBODIMENTS

Referring now to the single FIGURE of the drawing in detail, it is seen that waste A to be disposed of is fed through a waste feed device la to a carbonization drum 1 where it is carbonized at low temperatures and divided into carbonization gas SG and carbonization residue SR. A carbonization gas outlet line 2, 2' joins the carbonization drum 1 to a combustion chamber 3. A carbonization residue outlet line 4 connects the carbonization drum 1 to a separation device 5 in which the carbonization residue SR is divided into a coarse fraction GR and a fine fraction FR. The coarse fraction GR essentially contains metal parts, glass and stones. The fine fraction FR essentially contains carbon-containing carbonization residue. The separation device 5 can be constructed as a screen. An outlet line 5*a* for the coarse fraction GR and an outlet line 6 for the fine fraction FR of the carbonization residue SR lead from the separation device 5. The outlet line 6 for the fine fraction FR leads to a gasifier 7.

The gasifier 7 need only be externally heated to start up the apparatus. During continuous operation, a fraction of the material feed is burnt, which delivers the necessary thermal energy for gasifying the remaining carbon-containing material. Oxygen-enriched air L or pure oxygen is fed to the gasifier 7 through an air feedline 8. In this way, in the gasifier 7, a very high temperature is achieved which can be 2000° C. At this temperature which is above the melting point of all non-combustible materials being fed, the fine fraction FR of the carbonization residue SR which is fed to the gasifier 7 is converted into molten slag S and a synthesis gas SY. Since the amount of air being fed is kept small in comparison to the amount of carbonization residue, the gasification proceeds in an oxygen deficit so that the synthesis gas SY essentially is formed of carbon monoxide. The molten slag S is let off from the gasifier 7 through a slag outlet line 9 and passes into a water vessel 10 where melt granules form. The melt granules can be used as raw material.

The synthesis gas SY leaves the gasifier 7 through a synthesis gas outlet line 11 which leads to the combustion chamber 3. In the present case, the synthesis gas SY is burnt together with the carbonization gas SG in the combustion chamber 3. Separate combustion of the gases SG and SY is also possible. Since only gases are fed to the combustion chamber 3, a cost-effective small combustion chamber 3 is sufficient. Oxygen-enriched air L* or pure oxygen can be fed to the combustion chamber 3 through an air feedline 12. Complete combustion takes place in the combustion chamber 3. A flue gas outlet line 13 for flue gas RG leads from a flue gas outlet 3*a* of the combustion chamber 3, through a waste-heat steam generator or heat exchanger 14 and a flue gas purification device 15, which has a dust outlet 15*a*, to a stack 16.

A first gas scrubber 17 can be disposed in the carbonization gas outlet line 2, 2' of the carbonization drum 1. Sludge SCH which is separated off there passes through a sludge outlet line 18 to the gasifier 7. A partial section 2' of the carbonization gas outlet line 2, 2' through which scrubbed carbonization gas SGW flows, leads from the first gas scrubber 17 to the combustion chamber 3. The first gas scrubber 17 ensures that the combustion chamber 3 remains free of solid contaminants of the carbonization gas SG.

The synthesis gas SY can be fed through a separate synthesis gas outlet line 19, 19' (shown in broken lines) to a combustion chamber 20*a* of a gas engine 20 and burnt there, instead of being fed to the combustion chamber 3.

Burning the synthesis gas in both combustion chambers 3, 20*a* is also possible. A second gas scrubber 21 can be inserted into the synthesis gas outlet line 19, 19' as well as into the synthesis gas outlet line 11. Scrubbed synthesis gas SYW then passes into the combustion chamber 20*a* or 3. This ensures that the solid constituents which can be present in the synthesis gas SY do not pass into the combustion chamber 3 or into the gas engine 20. These solid constituents pass as sludge SC through a sludge outlet line 22 back into the gasifier 7. The gas engine 20 can drive a non-illustrated generator. A flue gas outlet line 23 (shown in broken lines) exiting from a flue gas outlet 20*b* of the gas engine 20 is connected to an inlet of the flue gas purification device 15 in order to receive flue gas RG' that is given off. Dust ST that is separated off in the flue gas purification device 15 as well as dust ST that is separated off in the waste-heat steam generator or heat exchanger 14, can be passed through dust outlet lines 25, 24 to the gasifier 7.

The advantage achieved through the use of the apparatus described above is that only gases are fed to the combustion chamber 3 and/or the gas engine 20. No solid matter passes thereto. A cost-effective combustion chamber is therefore sufficient.

The use of a gas engine 20 is only made possible by using the gasifier 7 disposed upstream, since the gas engine 20 can only be operated with gas.

We claim:

1. A process for disposing of waste, which comprises:

carbonizing waste at low temperatures, to develop carbonization gas and solid carbonization residue;

burning the carbonization gas;

dividing the carbonization residue into a coarse and a fine fraction;

subjecting the fine fraction to a gasification at a gasification temperature above a melting temperature of materials being subjected to the gasification and not being combustible, to develop synthesis gas and molten slag; and burning the synthesis gas unpurified.

2. The process according to claim 1, which comprises burning the synthesis gas together with the carbonization gas.

3. The process according to claim 1, which comprises carrying out the combustion with a feed of oxygen-enriched air.

4. The process according to claim 1, which comprises carrying out the gasifying of the fine fraction with a feed of oxygen-enriched air.

5. The process according to claim 1, which comprises scrubbing the carbonization gas, burning the scrubbed carbonization gas, and gasifying sludge being separated off during scrubbing.

6. The process according to claim 1, which comprises freeing dust from flue gas developing in the combustion of at least one of the synthesis gas and the carbonization gas, and gasifying the dust.

7. The process according to claim 1, which comprises introducing the molten slag into a water bath.

8. The process according to claim 1, which comprises taking off thermal energy from flue gas developing in the combustion of at least one of the synthesis gas and the carbonization gas.

9. An apparatus for disposing of waste, comprising:

a waste feed device;

a carbonization drum disposed downstream of said waste feed device;

a carbonization gas outlet line and a carbonization residue outlet line discharging from said carbonization drum;

a combustion chamber being connected to said carbonization gas outlet line and having a flue gas outlet;

a separation device being connected to said carbonization residue outlet line and having a coarse fraction outlet line and a fine fraction outlet line;

a gasifier being connected to said fine fraction outlet line and having a slag outlet line and a synthesis gas outlet line; and a combustion chamber being directly connected to said synthesis gas outlet line.

10. The apparatus according to claim 9, wherein said combustion chamber being connected to said carbonization gas outlet line and said combustion chamber being connected to said synthesis gas outlet line are the same combustion chamber.

11. The apparatus according to claim 9, including a feedline for oxygen-enriched air discharging into said gasifier.

12. The apparatus according to claim 9, including a gas scrubber being connected to said carbonization gas outlet line of said carbonization drum and having a carbonization gas outlet line for scrubbed carbonization gas and a sludge outlet line for sludge, said carbonization gas outlet line for scrubbed carbonization gas being connected to said combustion chamber and said sludge outlet line being connected to said gasifier.

13. The apparatus according to claim 9, including a flue gas purification device being connected to said flue gas outlet of said combustion chamber and having a dust outlet being connected to said gasifier.

14. The apparatus according to claim 9, including a heat exchanger being associated with said flue gas outlet of said combustion chamber.

15. The apparatus according to claim 9, including a water vessel into which said slag outlet line of said gasifier discharges.

* * * * *